US005818321A

United States Patent [19]

Muramatsu et al.

[11] Patent Number: 5,818,321

[45] Date of Patent: Oct. 6, 1998

[54] FUSE WITH SECONDARY SHORT-CIRCUIT PREVENTION MECHANISM

[75] Inventors: Kenji Muramatsu; Goro Nakamura, both of Shizuoka, Japan

[73] Assignee: Yazaki Corporation, Tokyo, Japan

[21] Appl. No.: 953,650

[22] Filed: Oct. 17, 1997

[30] Foreign Application Priority Data

Oct. 18, 1996 [JP] Japan ..... 8-276631

[51] Int. Cl.[6] ..... H01H 85/04; H01H 85/045

[52] U.S. Cl. ..... 337/198; 337/261; 337/263

[58] Field of Search ..... 337/261, 198, 337/159, 197, 142, 186, 190, 195, 214, 238–240, 260, 295, 401, 405, 407, 414, 415; 361/626, 835, 837, 601, 642, 646

[56] References Cited

U.S. PATENT DOCUMENTS

| | | | |
|---|---|---|---|
| 4,871,990 | 10/1989 | Ikeda et al. | 337/238 |
| 4,943,248 | 7/1990 | Colleran et al. | 439/850 |
| 5,416,461 | 5/1995 | Totsuka et al. | 337/261 |

*Primary Examiner*—Leo P. Picard
*Assistant Examiner*—Anatoly Vortman
*Attorney, Agent, or Firm*—Morgan, Lewis & Bockius LLP

[57] ABSTRACT

There is disclosed a fuse with a secondary short-circuit prevention mechanism in which a melting portion, when melted, will not be brought into an unstably supported-condition, thereby positively preventing the melting portion from being again short-circuited. A fuse element 23 includes a pair of parallel terminal portions 29 and 29 interconnected by a connecting portion 31, and a fusible portion 33 is formed at the connecting portion 31. A housing 25 includes terminal receiving chambers for respectively receiving the terminal portions 29 and 29, and a fuse element receiving space for receiving the connecting portion 31, the terminal receiving chambers communicating with the fuse element receiving space. Fixing means 47 and 63 for fixing opposite ends of the connecting portion 31 to an inner surface of the fuse element receiving space 53 are provided at the opposite ends of the connecting portion 31 and the inner surface of the fuse element receiving space, and the fusible portion 33 is provided between the opposite ends of the connecting portion 31.

7 Claims, 6 Drawing Sheets

FUSE WITH SECONDARY SHORT-CIRCUIT PREVENTION MECHANISM

BACKGROUND OF THE INVENTION

This invention relates to a cartridge-type fuse used in electric wiring in an automobile or the like, and more particularly to a fuse provided with a secondary short-circuit prevention mechanism for preventing a melted portion-from being again short-circuited.

As shown in FIG. 1, generally, a cartridge-type fuse 1, used in an automobile or the like, comprises a housing 3 made of a synthetic resin, a fuse element 9, which includes a pair of female terminals 5 and 5 interconnected by a fusible portion 7, and is mounted in the housing 3, and a cover 11 closing an open top of the housing 3. When the fuse element 9 is inserted into the housing 3 through the open top thereof, resilient retaining arms 13, formed respectively by stamping out part of the female terminals 5 and 5, are retainingly engaged respectively with retaining step portions 15 (see FIG. 2) on an inner surface of the housing 3, so that the fuse element 9 is received in the housing 3 so as to be disengageable with each other. Therefore, when the pair of female terminals 5 and 5 are thus retained, the fusible portion 7 of the fuse element 9 is indirectly retained within the housing 3.

In use, as shown in FIG. 2, the fuse 1 of this construction is mounted in a terminal receiving chamber of a fuse holder 19 having male terminals 17 and 17 corresponding respectively to the female terminals 5 and 5.

In the above conventional fuse 1, however, the fuse element 9 is fixed to the housing 3 only by the pair of female terminals 5 and 5, and therefore if a backlash due to tolerances is present between an element receiving space in the housing 3 and the fuse element 9, the fusible portion 7 is supported in a cantilever manner, as shown in FIG. 3, to become unstable when the fusible portion 7 is melted, which may lead to a problem that opposed ends of a melted portion 7*a*, spaced from each other by a melting gap, are again brought into contact with each other by vibrations and others, thereby causing a short-circuit.

SUMMARY OF THE INVENTION

The present invention has been made in view of the above problem, and an object of the invention is to provide a fuse with a secondary short-circuit prevention mechanism in which a melting portion, when melted, will not be brought into an unstably supported-condition, thereby positively preventing the melting portion from being again short-circuited.

The above object of the invention has been achieved by a fuse with a secondary short-circuit prevention mechanism comprises:

- a fuse element including a pair of parallel terminal portions interconnected by a connecting portion, a fusible portion being formed at the connecting portion;
- a housing including terminal receiving chambers for respectively receiving the terminal portions, and a fuse element receiving space for receiving the connecting portion, the terminal receiving chambers communicating with the fuse element receiving space; and
- fixing means for fixing opposite ends of the connecting portion to an inner surface of the fuse element receiving space, the fixing means being provided at the opposite ends of the connecting portion and the inner surface of the fuse element receiving space, and the fusible portion being provided between the opposite ends of the connecting portion.

Preferably, the fixing means of the fuse with the secondary short-circuit prevention mechanism comprises fitting arm portions formed respectively on vertical portions of the connecting portion defined respectively by the opposite end portions of the connecting portion, and retaining projections formed on the inner surface of the fuse element receiving space, the vertical portions being parallel to a direction of insertion and withdrawal of the fuse element.

In this fuse with the secondary short-circuit prevention mechanism, when the fuse element is inserted into the housing, the connecting portion is fixed to the inner surface of the fuse element receiving space by the fixing means, with the terminal portions received respectively in the terminal receiving chambers. As a result, the fuse element is fixed to the housing by the pair of terminal portions and the opposite ends of the connecting portion, and even if the fusible portion is melted by an excess current, the fuse element is supported at upper end lower ends, and opposed ends of a melted portion will not be again brought into contact with each other.

In the fuse with the secondary short-circuit prevention mechanism in which the fixing means comprises the fitting arm portions, formed on the connecting portion, and the retaining projections formed on the inner surface of the fuse element receiving space in a projected manner, the direction of insertion of the fuse element is the same as the direction of fitting of each fitting arm portion on the retaining projection, and the fitting arm portions can be fitted respectively on the retaining projections simultaneously with the insertion of the fuse element.

DETAILED DESCRIPTION OF THE PREFERRED EMBODIMENTS

A preferred embodiment of a fuse of the invention with a secondary short-circuit prevention mechanism will now be described in detail with reference to the drawings.

Figure 1:
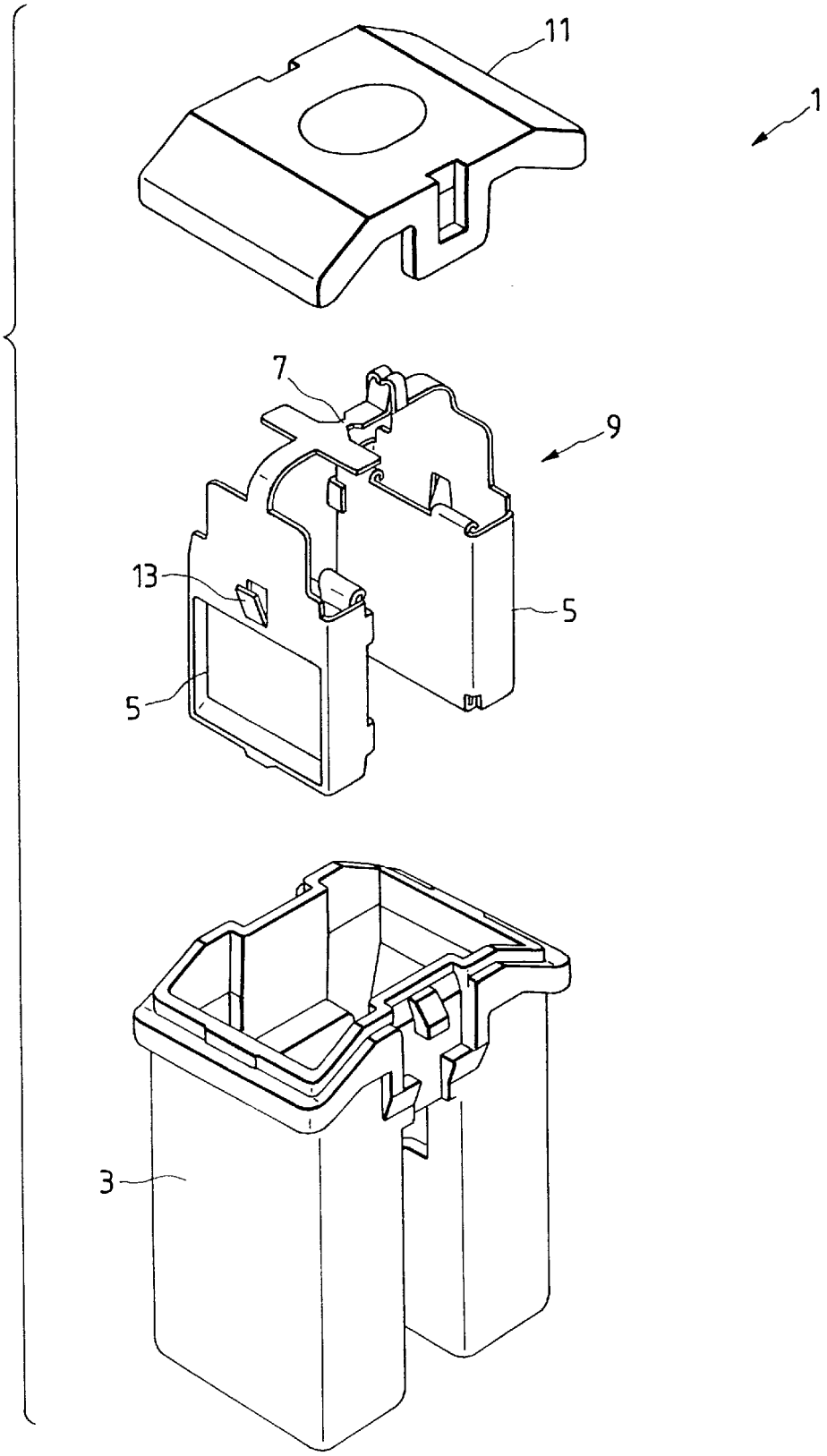
FIG. 1 PRIOR ART
FIG. 1 is an exploded, perspective view of a conventional fuse.
Figure 2:
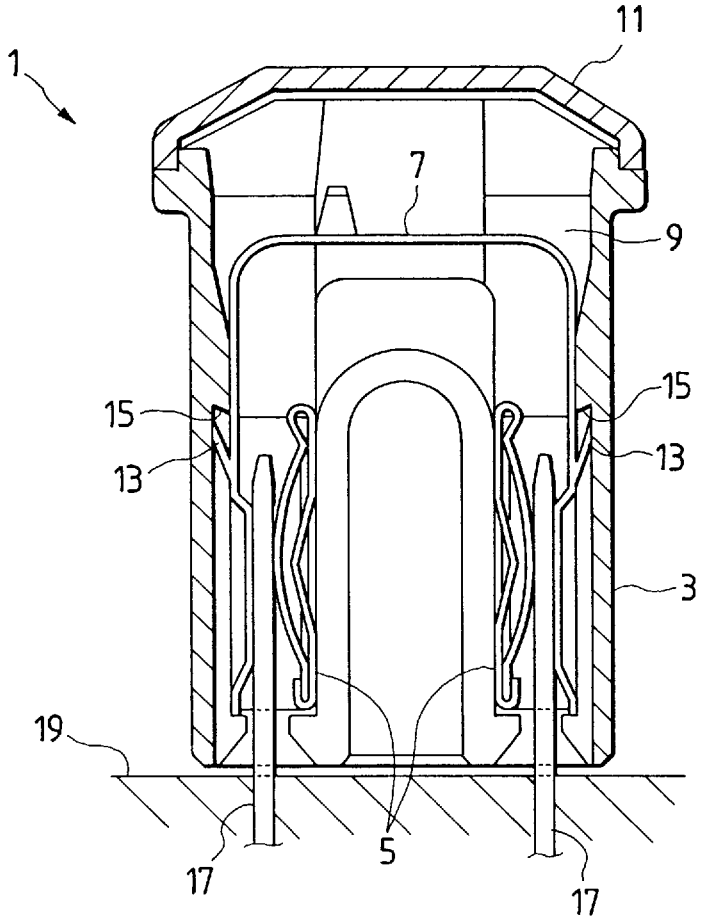
PRIOR ART FIG. 2
FIG. 2 is a vertical cross-sectional view of the conventional fuse of FIG. 1 in its assembled condition.
Figure 3:
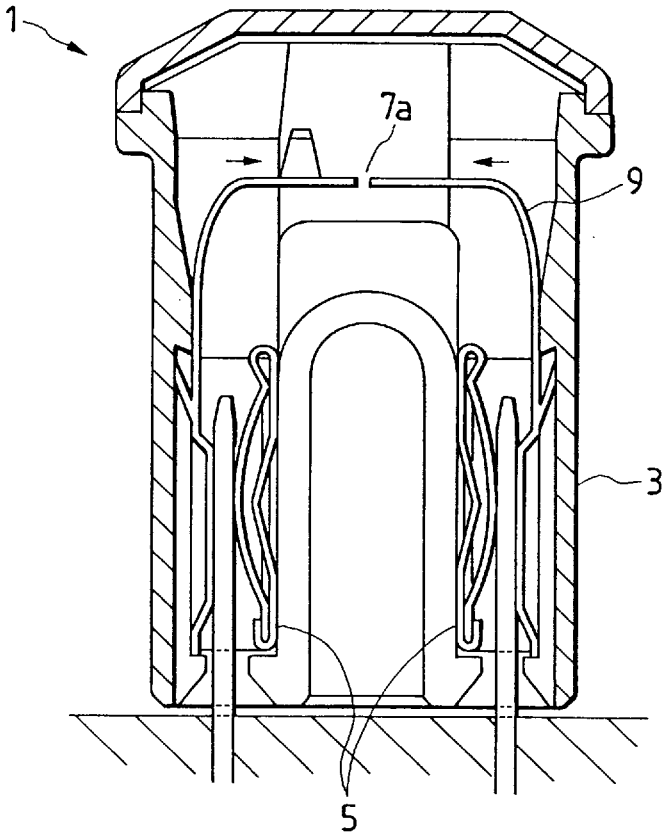
PRIOR ART FIG. 3
FIG. 3 is a vertical cross-sectional view of the conventional fuse of FIG. 2 in a melted condition.
Figure 4:
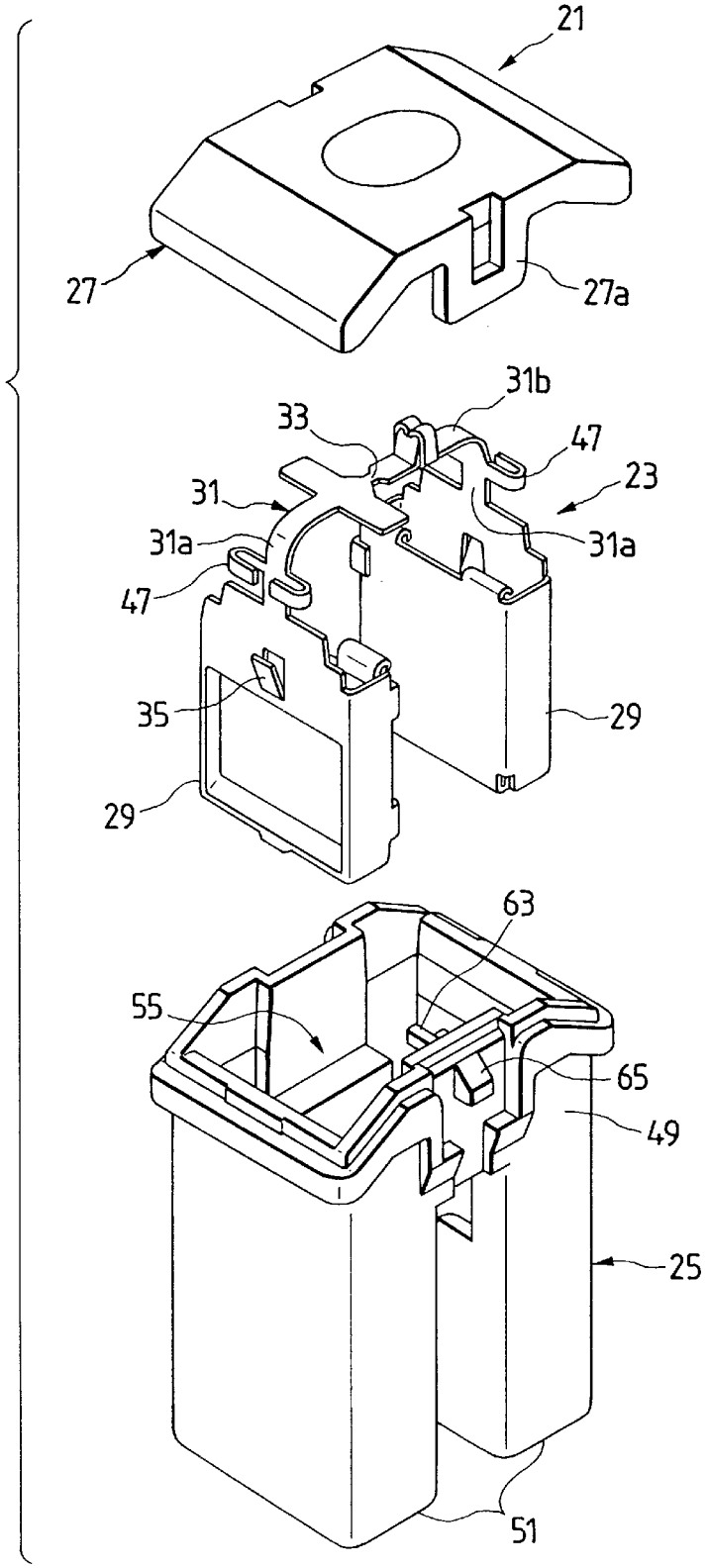
FIG. 4 is an exploded, perspective view of a fuse of the present invention with a secondary short-circuit prevention mechanism.
Figure 5:
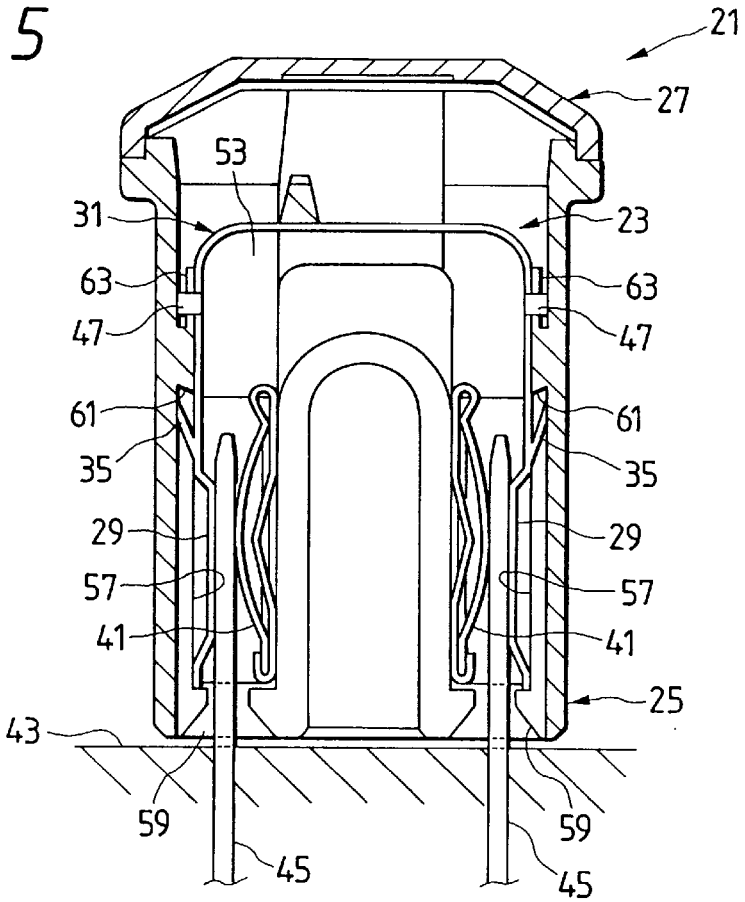
FIG. 5 is a vertical cross-sectional view of the fuse of FIG. 4 in its assembled condition.
Figure 6A:
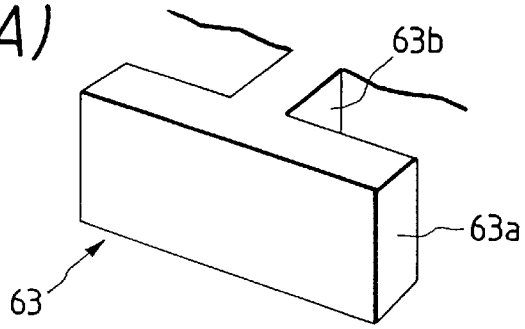
FIGS. 6(A) and 6(B) are perspective views respectively showing examples of retaining portion shown in FIG. 4.
Figure 6B:
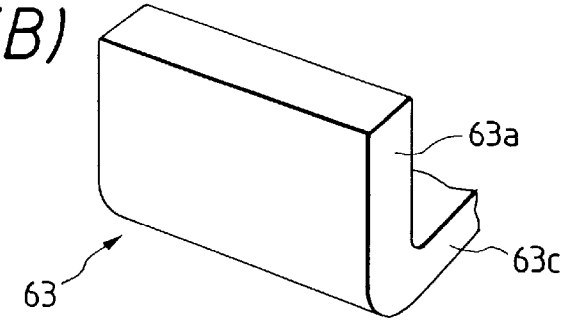
Figure 7:
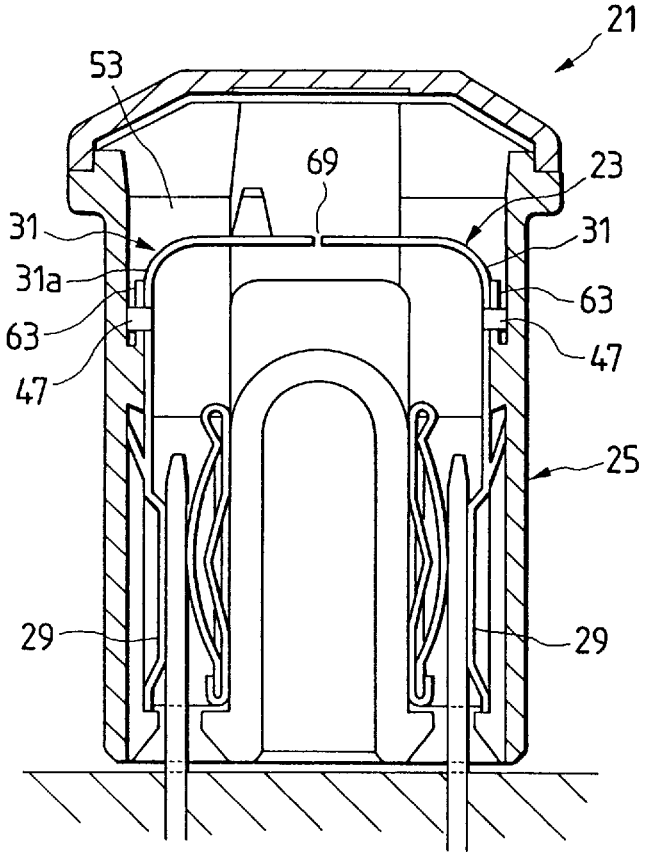
FIG. 7 is a vertical cross-sectional view of the fuse of FIG. 5 in a melted condition.

FIG. 4 is an exploded, perspective view of the fuse of the invention with the secondary short-circuit prevention mechanism, FIG. 5 is a vertical cross-sectional view of the fuse of FIG. 4 in its assembled condition, FIGS. 6(A) and 6(B) are perspective views respectively showing examples of retaining portion shown in FIG. 4, and FIG. 7 is a vertical cross-sectional view of the fuse of FIG. 5 in a melted condition.

The fuse 21 with the secondary short-circuit prevention mechanism (hereinafter referred to merely as "fuse") broadly comprises a fuse element 23, a housing 25, and a cover 27.

The fuse element 23 includes a pair of female terminal portions 29 and 29, a connecting portion 31 interconnecting these female terminal portions 29 and 29, and a fusible portion 33 formed at a central portion of the connecting portion 31. The fuse element 23 can be formed by blanking an electrically-conductive metal sheet to provide a sheet having a shape corresponding to the female terminal portions 29 and 29, the connecting portion 31 and the fusible portion 33 in their developed condition, and then by bending this sheet into a predetermined configuration.

Resilient retaining arms 35 are formed by stamping on outer surfaces of the female terminal portions 29 and 29, respectively, and the resilient retaining arms 35 are retainingly engaged respectively with retaining step portions provided respectively in terminal receiving chambers (described later) in the housing 25. An electrical contact piece 41 of a resilient nature is provided within each of the boxed-shaped female terminal portions 29 and 29, and when the fuse 21 is mounted on a fuse holder 43, the electrical contact pieces 41 are press-contacted respectively with contact male terminals 45 and 45 mounted in the fuse holder 43.

The connecting portion 31 of a generally inverted U-shaped is formed by vertical portions 31*a* and 31*a* and a horizontal portion 31*b* interconnecting the vertical portions 31*a* and 31*a*, the vertical portions 31*a* and 31*a* extending upwardly respectively from upper ends of the pair of female terminal portions 29 and 29 arranged in parallel relation to each other in an upward-downward direction (i.e., a direction of insertion and withdrawal of the fuse element 23) in FIG. 4. Therefore, the fusible portion 33 is formed at a central portion of the horizontal portion 31*b*. The fusible portion 33 is formed by reducing a width (and hence a cross-sectional area) of the relevant portion of the horizontal portion 31*b* into a predetermined value. Therefore, by forming the fusible portion 33 into a desired cross-sectional area, the fuse element 23 of a desired rating can be obtained.

A fitting arm portion (fixing means) 47 is formed on each of the vertical portions 31*a* and 31*a* of the connecting portion 31. The fitting arm portion 47 is formed by a pair of small plate portions which extend respectively from opposite side edges of the vertical portion 31*a* in a direction of the width thereof, and are bent into a C-shape, with their distal ends opposed to each other. The fitting arm portions 47 are fitted respectively on fixing means (described later) formed on an inner surface of the housing 25.

The housing 25 is made of a synthetic resin, and includes a base portion 49, and terminal receiving portions 51 extending from this base portion 49 in a bifurcated manner, and the base portion 49 and the terminal receiving portions 51 are molded into an integral construction. A fuse element receiving space 53 is formed in the base portion 49, and the fuse element receiving space 53 has an open top 55 open to the upper side of the housing 25. The terminal receiving chambers 57, communicating with the fuse element receiving space 53, are formed respectively in the terminal receiving portions 51, and each of the terminal receiving chambers 57 has a male terminal insertion port 59 formed at a distal end of the terminal receiving chamber 57. The retaining step portions 61 are formed respectively in the terminal receiving chambers 57, and these retaining step portions 61 are engaged respectively with the resilient retaining arms 35 of the female terminal portions 29 and 29 as described above.

Retaining projections (fixing means) 63 are formed respectively on opposed inner surfaces of the fuse element receiving space 53. One example of retaining projection 63 includes a vertical small plate 63*a* which is parallel to the inner surface, and is supported by a vertical support plate 63*b* as shown in FIG. 6(A). In addition, as shown in FIG. 6(B), another example of retaining projection 163 includes a vertical small plate 163*a* which is parallel to the inner surface, and is supported by a horizontal support plate 163*c*. When the female terminal portions 29 and 29 of the fuse element 23 are inserted respectively into the terminal receiving chambers 57, the retaining projections 63 are engaged respectively with the fitting arm portions 47 formed on the connecting portion 31.

Cover retaining projections 65 are formed respectively on a pair of parallel outer surfaces of the housing 25, and the cover retaining projections 65 are retainingly engaged respectively with retaining portions 27*a* of the cover 27 attached to the open top portion 55, thereby fixing the cover 27 to the housing 25.

The operation of the fuse 21 of this construction will now be described.

The fuse element 23 is mounted in the fuse element receiving space 53 in the housing 25, and the cover 27 is attached to the open top portion 55, so that the fuse 21 is assembled as shown in FIG. 5.

The female terminal portions 29 and 29 of the fuse element 23 are mounted respectively in the terminal receiving chambers 57, with the connecting portion 31 disposed in the fuse element receiving space 53, and the fitting arm portions 47, formed respectively on the vertical portions 31*a* and 31*a* of the connecting portion 31, are fitted respectively on the retaining projections 63 formed on the inner surface of the fuse element receiving space 53.

Namely, the fuse element 23 is fixed to the housing 25 by the pair of female terminal portions 29 and 29 and the vertical portions 31*a* and 31*a* respectively defining the opposite end portions of the connecting portion 31.

The vertical portions 31*a* and 31*a* are thus fixed respectively to the retaining projections 63, and therefore even if a gap due to tolerances is present between the fuse element receiving space 63 and the fuse element 23, the rattling or shaking will not occur.

As a result, even if the fusible portion 33 is melted by an excess current, so that the fuse element 23 is divided into two portions by a melted portion 69 as shown in FIG. 7, each of these two portions is supported at its opposite end portions by the vertical portion 31*a* and the female terminal portion 29 disposed at a level lower than the vertical portion 31*a*, so that these two portions are positively fixed to the inner surface of the fuse element receiving space 53, and therefore opposed ends of the melted portion 69, spaced from each other by a melting gap, will not be again brought into contact with each other by vibrations and others.

Thus, in the above fuse 21, the fitting arm portions 47 are formed on the connecting portion 31 of the fuse element 23, and the retaining projections 63 for fitting respectively in the fitting arm portions 47 are formed on the inner surface of the fuse element receiving space 53, and therefore when the fuse element 23 is mounted in the housing 25, the connecting portion 31, having the fusible portion 33, can be positively fixed to the housing 25, and even if the fusible portion 33 is melted, so that the fuse element 23 is divided into two portions, each of these two portions can be supported at its upper and lower end portions, and the opposed ends of the melted portion 69, spaced from each other by a melting gap, are positively prevented from being brought into contact with each other.

In the above fuse 21, the fitting arm portions 47 are formed respectively on the vertical portions 31*a* and 31*a* of the connecting portion 31, and the retaining projections 63 are formed on the inner surface of the fuse element receiving space 53 in a projected manner, and therefore the fitting arm portions 47 can be easily fitted respectively on the retaining projections 63 simultaneously with the mounting of the fuse element 23, and the efficiency of the assembling operation will not be lowered.

In the fuse 21 of the present invention, although the above fixing means comprises the fitting arm portions 47, formed on the fuse element 23, and the retaining projections 63 formed on the housing 25, there may be used a reverse arrangement in which the retaining projections 63 are formed on the fuse element 23 while the fitting arm portions 47 are formed on the housing 25.

In the above embodiment, although the fitting arm portions 47, serving as the fixing means, are formed respectively on the vertical portions 31*a* and 31*a* of the connecting portion 31, the fixing means may be formed on the horizontal portion 31*b*. In this case, fitting holes into which the fixing means can be fittingly inserted are suitably used as the fixing means provided at the horizontal portion 31, and bosses or the like for fitting respectively in these fitting holes are suitably used as the fixing means provided at the housing 25.

As described above in detail, in the fuse of the invention with the secondary short-circuit prevention mechanism, the fixing means are provided at the connecting portion of the fuse element and the inner surface of the fuse element receiving space, and therefore the connecting portion is fixed to the inner surface of the fuse element receiving space by the fixing means, and even if the fusible portion is melted by an excess current, so that the fuse element is divided into two portions, each of these two portions is supported at its upper and lower end portions, and therefore the opposed ends of the melted portion are positively prevented from being brought into contact with each other.

In the fuse with the secondary short-circuit prevention mechanism in which the fixing means comprises the fitting arm portions and the retaining projections, the direction of insertion of the fuse element is the same as the direction of fitting of each fitting arm portion on the retaining projection, and the fitting arm portions can be fitted respectively on the retaining projections simultaneously with the insertion of the fuse element, and therefore the efficiency of the fuse element-assembling operation will not be lowered.

While there has been described in connection with the preferred embodiment of the invention, it will be obvious to those skilled in the art that various changes and modifications may be made therein without departing from the invention, and it is aimed, therefore, to cover in the appended claim all such changes and modifications as fall within the true spirit and scope of the invention.

What is claimed is:

1. A fuse with a secondary short-circuit prevention mechanism comprises:

a fuse element including a pair of parallel terminal portions interconnected by a connecting portion, a fusible portion being formed at said connecting portion;

a housing including terminal receiving chambers for respectively receiving said terminal portions, and a fuse element receiving space for receiving said connecting portion, said terminal receiving chambers communicating with said fuse element receiving space; and fixing means for fixing opposite ends of said connecting portion to an inner surface of said fuse element receiving space, said fixing means being provided at the opposite ends of said connecting portion and said inner surface of said fuse element receiving space, and said fusible portion being provided between said opposite ends of said connecting portion.

2. A fuse according to claim 1, in which said fixing means comprises:

fitting arm portions formed respectively on vertical portions of said connecting portion defined respectively by the opposite end portions of said connecting portion; and retaining projections formed on the inner surface of said fuse element receiving space, said vertical portions being parallel to a direction of insertion and withdrawal of said fuse element.

3. A fuse according to claim 1, in which said connecting portion is a generally inverted U-shaped and is formed by vertical portions and a horizontal portion interconnecting said vertical portions, said vertical portions extending upwardly respectively from upper ends of the pair of said terminal portions arranged in parallel relation to each other in the direction of insertion and withdrawal of said fuse element.

4. The fuse according to claim 3, in which said fixing means comprises:

fitting arm portions formed respectively on said vertical portions of said connecting portion retaining projections respectively engaged with said fitting arm portions and formed on the inner surface of said fuse element receiving space.

5. The fuse according to claim 3, in which said fixing means comprises:

retaining projections formed respectively on said vertical portions of said connecting portion fitting arm portions respectively engaged with said retaining projections and formed on the inner surface of said fuse element receiving space.

6. The fuse according to claim 3, in which said fixing means comprises:

retaining projections includes;

a horizontally extending support plate formed respectively on said vertical portions of said connecting portion, and a vertically extending plate which is parallel to the inner surface of said fuse element receiving space and is supported by said horizontally extending support plate, fitting arm portions respectively engaged with said retaining projections and formed on the inner surface of said fuse element receiving space.

7. The fuse according to claim 3, in which said fixing means comprises:

retaining projections includes;

a horizontally extending support plate formed respectively on the inner surface of said fuse element receiving space, and a vertically extending plate which is parallel to the inner surface of said fuse element receiving space and is supported by said horizontally extending support plate, fitting arm portions respectively engaged with said retaining projections and formed on said vertical portions of said connecting portion.

* * * * *